US012768161B2

(12) United States Patent
Herzog

(10) Patent No.: US 12,768,161 B2
(45) Date of Patent: Oct. 20, 2026

(54) FLOOD TAPE

(71) Applicant: Matthias Niklaus Herzog, Saint Augustine, FL (US)

(72) Inventor: Matthias Niklaus Herzog, Saint Augustine, FL (US)

( * ) Notice: Subject to any disclaimer, the term of this patent is extended or adjusted under 35 U.S.C. 154(b) by 298 days.

(21) Appl. No.: 18/484,715

(22) Filed: Oct. 11, 2023

(65) Prior Publication Data

US 2025/0122720 A1 Apr. 17, 2025

(51) Int. Cl.
*E04B 1/68* (2006.01)

(52) U.S. Cl.
CPC ..... *E04B 1/6803* (2013.01)

(58) Field of Classification Search
CPC .... C09J 7/00; C09J 2203/346; C09J 2301/31; E04B 1/625; E04B 1/6803
USPC ..... 156/71
See application file for complete search history.

(56) References Cited

U.S. PATENT DOCUMENTS 4,019,304 A * 4/1977 Timm ..... E04H 9/145 52/746.1
8,974,904 B2 * 3/2015 Dai ..... C23C 16/26 428/408
2021/0207005 A1 * 7/2021 Seabaugh ..... B32B 27/12

OTHER PUBLICATIONS

LLP International Group, LLPT Nano Tape Double Sided Tape, Model SN650, Amazon.com listing, ASIN B08LKRJZPV, available at https://a.co/d/08kkrtyG (last accessed May 20, 2026.

* cited by examiner

*Primary Examiner* — James D Sells
(74) *Attorney, Agent, or Firm* — Fennemore Craig, P.C.

(57) ABSTRACT

A method to provide temporary waterproofing for buildings utilizes a waterproofing system comprising a repositionable adhesive tape. When the waterproofing system is applied to the building, then removed within 5 days, little or no adhesive residue remains on the building and no damage occurs. In an embodiment, the waterproof system includes additional protection.

6 Claims, 1 Drawing Sheet

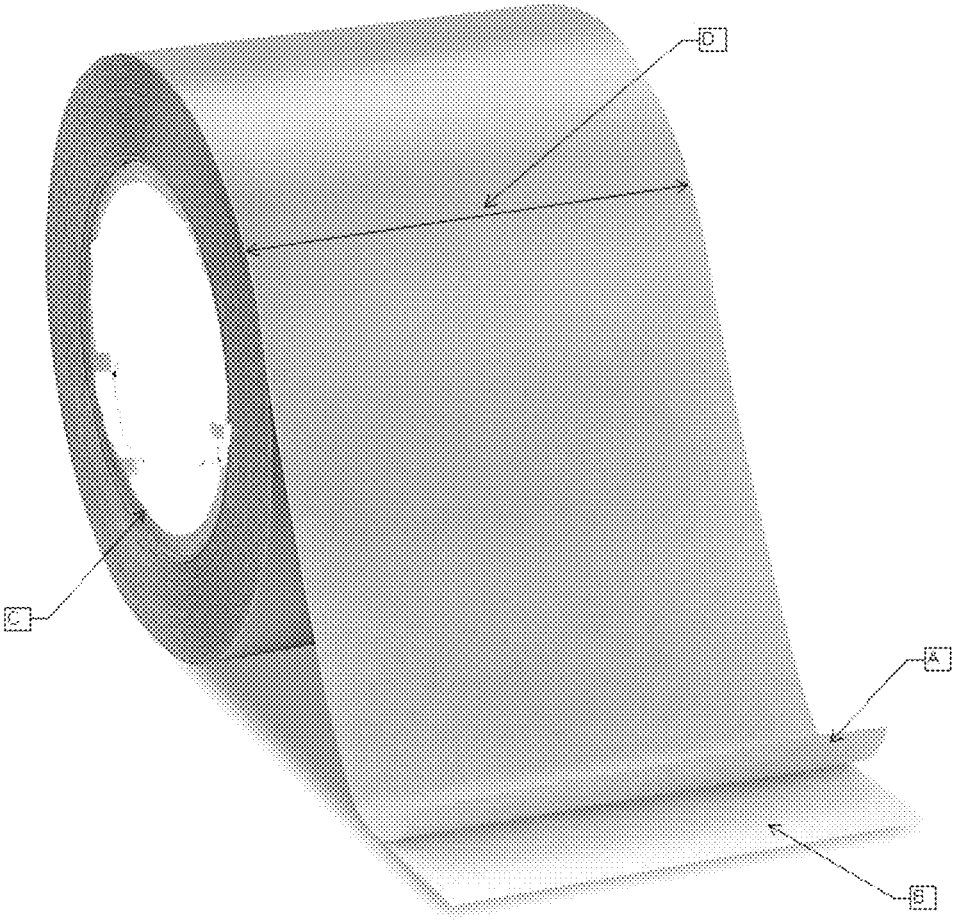
D
C
A
B

FLOOD TAPE

The present invention relates to a method to provide a temporary waterproofing system that can protect a building from water damage and, when removed in an appropriate manner, can be easily removed from the building surfaces without leaving large quantities of residue or damage to the surface.

BACKGROUND

Hurricanes and other large storms can cause significant water damage to houses and other buildings. It is known to mitigate this problem by applying waterproofing such as sandbags, tapes, caulking and/or spray coatings or foams in advance of the arrival of the storm. However, after the storm has passed and the waterproofing is removed, there may be other types of problems—for example, the waterproofing may adhere so strongly to the building that it may be difficult to remove without damaging the surface it was applied to and/or the waterproofing may leave large amounts of sticky adhesive residue on the building. The present invention mitigates these problems.

SUMMARY OF THE INVENTION

In an embodiment, the present invention provides a method to temporarily waterproof a building, said method comprising:

1) applying a temporary waterproofing system to said building; and
2) removing said temporary waterproofing system within 5 days, wherein said temporary waterproofing system is characterized by:

A) having sufficient adhesive strength to adhere to said building for minimum of 14 days;
B) not leaving undesirable deposits of adhesive residue on said building when removed within 7 days;
C) comprising a repositionable adhesive tape; and
D) being sufficiently waterproof to reduce the ingress of water into the building when the tape is exposed to water.

In an embodiment, the repositionable adhesive tape is a nano tape. The term "nano tape" as used herein is meant to convey its conventional meaning. A non-limiting description of nano tape was published on-line (on Wikipedia) and includes a statement describing nano tape as a "synthetic adhesive tape consisting of arrays of carbon nanotubes transferred onto a backing of flexible polymer tape"

In another embodiment, the nano tape is a double sided nano tape.

In an embodiment, the tape is removed within 1 to 3 days after being applied.

The term "repositionable" as used herein means that the tape may be placed into position, then removed, then—if necessary or desired—the tape may be removed and then placed into position again (in the same spot or another spot) while still retaining sufficient adhesive strength to adhere to the building

BRIEF DESCRIPTION OF THE DRAWINGS

FIG. 1 is a drawing showing a tape of the disclosed method.

DETAILED DESCRIPTION OF PREFERRED EMBODIMENTS

The temporary waterproofing system of this invention may be a double sided, repositionable adhesive tape. This tape is attached to the building using the adhesive on one side of the tape. In an embodiment, the double sided tape is provided as a roll. In a preferred embodiment, a backing layer is provided to prevent the layers of tape from sticking to each other while on the roll. In an embodiment, this backing layer may be left on the tape after the tape is applied to the building. In this embodiment, the backing is preferably waterproof.

In another embodiment, the backing layer is removed from the double sided tape. For the sake of convenience, this may be done after the tape has been applied to the building. The removal of the backing layer exposes the second adhesive side of the tape and facilitates the addition of at least one other additional type of protection to the temporary waterproofing system. In an embodiment, the additional protection is a protective layer that provides further mechanical strength (non-limiting examples of such a protective layer include metal strips; metal foils or durable polymeric films) and/or additional water resistance.

In an embodiment, the amount of adhesive residue that is left on the building after removal of the repositionable adhesive tape is less than 10 milligrams per 100 square centimeters of the tape applied. In an embodiment, the amount of adhesive residue that is left on the building after removal of the repositionable adhesive tape is less than 5 milligrams per 100 square centimeters of the tape applied and the residue is not visible to the naked eye.

In an embodiment, the repositionable adhesive tape is a nano tape. In an embodiment, the nano tape is further characterized by being 1) washable and re-useable; 2) transparent; 3) containing a stabilizer to protect against ultraviolet (UV) radiation and 4) being manufactured with a silicone gel. In an embodiment, this nano tape is further characterized by being double sided In an embodiment, this tape has a thickness (not including the backing layer) of from 1 to 3 millimeters (especially from 1.5 to 2.5 mm) and a width of from 3 to 20 centimeters (especially from 6 to 20 cm). A commercially available, non-limiting example of a double sided tape having this thickness and also having characteristics 1) to 4) described in this paragraph is sold under the name LLPT tape. This LLPT tape is described by the manufacturer as being suitable for holding carpet onto a floor (which is a common application for double sided tapes) or adhering in place such small objects as a mailbox, a sign or a mirror. The manufacturer further reports that the tape is designed to hold a weight of up to 8.5 pounds (slightly less than 4 kilograms) "in the short term" and 17 pounds (slightly less than 8 kilograms) after 8 hours. The manufacturer recommends against using the tape on painted surfaces, stating "never use the tape on any painted surface or it will damage your paintings". However, we have discovered that this tape may be used temporarily (i.e. used for no more than 5 days, especially no more than 3 days, before being removed) on exterior housing materials without causing damage.

The invention will now be illustrated by the following, non-limiting examples:

EXPERIMENTAL

Overview

Sixteen tapes were tested. All were commercially available products. Descriptions of these tapes are provided below.

The tapes were tested under two types of conditions, namely "Ambient" and "Submerged" as described below.

Referring to FIG. 1, an embodiment of the disclosed Floodtape is shown to have a Backing layer (A), a Nano gel thickness of from 1 to 3 millimeters (especially from 1.5 to 2.5 mm) (B), a Support roll (C), and a width of from 3 to 20 centimeters (especially from 6 to 20 cm) (D).

Ambient Testing

Ambient testing was conducted by applying pieces of the tapes to different types of building materials, namely wood: vinyl door cladding; vinyl window cladding; metal hinges and stucco. The test specimens were exposed to outdoor conditions for a minimum of 72 hours. The tapes were then removed and the building material was examined for any damage that might have been caused by the tape and/or the amount of residue that was left by the tape.

The tapes were rated according to Adhesion performance (reported as Test A) and Damage/Residue performance (reported as Test B).

Ratings for Test A are Reported as Follows:

1—fail—tape became detached or very loose

2—marginal pass—tape remained attached but showed loose edges or corners

3—excellent—tape remained fully attached

Ratings for Test B are Reported as Follows:

1—fail—tape could not be removed without damage to the building material and/or left sticky residue 2—marginal pass—tape came off surface easily but left residue behind 3—excellent—tape came off easily and did not leave visible residue or damage

Submerged Testing

A plastic container (believed to be made from polyvinylchloride) containing a slit having a width of min. ¼ inch (min. 6 millimeters) was used in this test. The test tapes were applied to the container so as to cover the slit. The container was then submerged in salt water to a depth of 12 inches (about 30 centimeters) for 48 hours after which time the tapes were removed. Tapes were rated according to Adhesion Performance under water (Test C) and Residue performance under water (Test D).

Ratings for Test C are Reported as Follows:

1—fail—taped became detached and/or significant water leakage was observed

2—partial failure—minor water leakage was observed

3—excellent—tape remained attached with no water leakage being observed

Ratings for Test D are Reported as Follows:

1—fail—extremely difficult to remove tape after being submerged in salt water and/or left visible residue 2—partial failure—tape could be easily removed but left visible residue 3—excellent—tape was easily removed and left no visible residue

Tape Descriptions

All tapes used in these tests were commercially available products.

The tapes are identified below by number (with information regarding the brand name and/or supplier shown in brackets)

Tape 1 (sold under the name LLPT Nano Tape by LLP International Group)

Tape 2 (sold under the name FLEX TAPE by Flex Seal Family of Products)

Tape 3 (sold under the name FLEX TAPE FLOOD by Flex Seal Family of Pro)

Tape 4 (sold under the name All Weather tape by 3M)

Tape 5 (sold under the name Medical Houseable sterile dressing by Houseables, Inc.)

Tape 6 (sold under the name NASHUA AQUA SEAL by Berry Global Inc.)

Tape 7 (sold under the name medical bandage by Welly)

Tape 8 (sold under the name medical tape by RockTape)

Tape 9 (sold under the name waterproof butyl tape by HAKKAX)

Tape 10 (sold under the name ALIEN SHIELD by Bell+Howell)

Tape 11 (sold under the name medical patch by Lioderm)

Tape 12 (sold under the name Stucco tape by 3M)

Tape 13 (sold under the name Automotive Performance Masking Tape by 3M)

Tape 14 (sold under the name CRYSTAL CLEAR by The Gorilla Glue Company)

Tape 15 (sold under the name DUCK TAPE by Maxwel Manufacturing)

As described above, the tapes were subjected to Ambient testing (tests A and B) and Submerged Testing (tests C and D). Test results are summarized in Table 1.

Only tapes 1 and 11 are suitable for use in the method of the present invention.

The remaining (comparative) tapes are considered to be unsuitable for use in the method of the present invention for reasons that may be ascertained by reviewing the results in Table 1 (for example, the results in Table 1 show that Tape 2 did provide excellent adhesion when submerged in salt water (rating of 3 in Test C) but it is not suitable for use in the present invention because it is difficult to remove and/or left residue on the test surface (ratings of only 1 in Tests B and D)

TABLE 1

| | TEST | | | | |
|---|---|---|---|---|---|
| TAPE# | A | B | C | D | TOTAL |
| 1 | 3 | 3 | 3 | 3 | 12 |
| 2 | 2 | 1 | 3 | 1 | 7 |
| 3 | 2 | 2 | 3 | 1 | 8 |
| 4 | 3 | 2 | 3 | 2 | 10 |
| 5 | 3 | 1 | 3 | 1 | 8 |
| 6 | 3 | 1 | 3 | 1 | 8 |
| 7 | 3 | 3 | 1 | 3 | 10 |
| 8 | 1 | 3 | 1 | 3 | 8 |
| 9 | 3 | 1 | 3 | 1 | 8 |
| 10 | 3 | 2 | 3 | 1 | 9 |
| 11 | 3 | 3 | 1 | 1 | 8 |
| 12 | 2 | 3 | 1 | 1 | 7 |
| 13 | 2 | 3 | 1 | 1 | 7 |
| 14 | 3 | 2 | 3 | 1 | 9 |
| 15 | 3 | 1 | 3 | 1 | 8 |

I claim:

1. A method to temporarily waterproof a building, said method comprising:

1) applying a temporary waterproofing system to said building; and 2) removing said temporary waterproofing system within 5 days, wherein said temporary waterproofing system is characterized by:

A) having sufficient adhesive strength to adhere to said building;

B) not leaving undesirable deposits of adhesive residue on said building when removed within 14 days;

C) comprising a repositionable adhesive tape;

D) being sufficiently waterproof to reduce the ingress of water into the building when said tape is exposed to water;

E) containing a stabilizer to protect against ultraviolet (UV) radiation, and

F) being manufactured with a silicone gel.

2. The method of claim 1 wherein said repositionable adhesive tape is a nano tape.

3. The method of claim 2 wherein said nano tape is double sided nano tape.

4. The method of claim 2 wherein said nano tape has a thickness of from 1 to 3 millimeters.

5. The method of claim 3 wherein said double sided nano tape contains a backing.

6. The method of claim 1 wherein said adhesive tape is removed within 3 days.

* * * * *